US010170003B2

(12) United States Patent
Boss et al.

(10) Patent No.: US 10,170,003 B2
(45) Date of Patent: Jan. 1, 2019

(54) DYNAMIC PARKING SPACE DEFINITION

(71) Applicant: INTERNATIONAL BUSINESS MACHINES CORPORATION, Armonk, NY (US)

(72) Inventors: Gregory J. Boss, Saginaw, MI (US); Jeremy R. Fox, Georgetown, TX (US); Andrew R. Jones, Round Rock, TX (US); Kevin C. McConnell, Austin, TX (US); John E. Moore, Jr., Brownsburg, IN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/413,467

(22) Filed: Jan. 24, 2017

(65) Prior Publication Data

US 2018/0211539 A1 Jul. 26, 2018

(51) Int. Cl.
*G08G 1/16* (2006.01)
*G08G 1/14* (2006.01)

(52) U.S. Cl.
CPC ..... *G08G 1/168* (2013.01); *G08G 1/141* (2013.01)

(58) Field of Classification Search
CPC ..... G08G 1/168; G08G 1/141
USPC ..... 340/932.2
See application file for complete search history.

(56) References Cited

U.S. PATENT DOCUMENTS 6,426,708 B1 6/2002 Trajkovic et al.
7,602,312 B2 10/2009 Danz et al.
8,279,087 B2 10/2012 Knoll et al.
2007/0010938 A1* 1/2007 Kubota ..... B60Q 9/008 701/532
2010/0152972 A1* 6/2010 Attard ..... B62D 15/027 701/42

(Continued)

FOREIGN PATENT DOCUMENTS

CN 104240511 A 12/2014
CN 204155464 2/2015
DE 102009057647 A1 6/2011

OTHER PUBLICATIONS

"New Parking Technology Could Make Finding An Open Spot Easier", [retrieved on Aug. 30, 2016]. Retrieved from the Internet:<URL:http://www.techtimes.com/articles/49315/20150428/new-parking-technology-could-make-finding-an-open-parking-spot-easier.htm>, Apr. 29, 2015, 2 pgs.

(Continued)

*Primary Examiner* — Omer S Khan
(74) *Attorney, Agent, or Firm* — Brian Restauro; Matthew M. Hulihan; Heslin Rothenberg Farley & Mesiti PC

(57) ABSTRACT

A method performs an automated measurement of dimension(s) of an arriving vehicle arriving at a parking area. The method obtains a skills assessment of a driver of the arriving vehicle, which indicates skill level of the driver in performing parking maneuver(s). The method dynamically defines, based on the dimension(s) of the arriving vehicle and the obtained skills assessment, a parking space in an unoccupied area within the parking area. The defining includes selecting dimensions of the dynamically defined parking space. The method directs the arriving vehicle to the dynamically defined parking space, the directing including providing live parking guidance to facilitate maneuvering the arriving vehicle into position in the dynamically defined parking space.

19 Claims, 8 Drawing Sheets

(56) References Cited

U.S. PATENT DOCUMENTS

| | | | | |
|---|---|---|---|---|
| 2010/0332080 | A1* | 12/2010 | Bae | B62D 15/028 701/42 |
| 2012/0112929 | A1* | 5/2012 | Gupta | G08G 1/146 340/932.2 |
| 2014/0067207 | A1 | 3/2014 | Noh | |
| 2014/0172221 | A1* | 6/2014 | Solyom | B62D 15/0285 701/23 |
| 2016/0117926 | A1 | 4/2016 | Akavaram et al. | |
| 2016/0221495 | A1* | 8/2016 | Cunningham, III | B60R 1/00 |
| 2017/0369074 | A1* | 12/2017 | Mathes | B60W 50/0098 |

OTHER PUBLICATIONS

"The Smart Parking Garage Project", (Video) [retrieved on Nov. 10, 2016]. Retrieved from the Internet: < URL: https://www.youtube.com/watch?v=_qb2KEfG1E0>, Nov. 23, 2013, 1 pg.

Mell, Peter, et al., "The NIST Definition of Cloud Computing", NIST Special Publication 800-145, Sep. 2011, Gaithersburg, MD, 7 pgs.

* cited by examiner

DYNAMIC PARKING SPACE DEFINITION

BACKGROUND

Safety is a consideration in the arrangement of vehicles in a parking area, such as a parking garage, and in the procedures to park vehicles in the parking area. Numerous automobile accidents occur during parking procedures. Meanwhile, over-population of cities has resulted in over-populated parking areas, exacerbating the concerns for safety when entering, exiting, and positioning vehicles in parking areas.

SUMMARY

Shortcomings of the prior art are overcome and additional advantages are provided through the provision of a computer-implemented method. The method performs an automated measurement of dimension(s) of an arriving vehicle arriving at a parking area. The method obtains a skills assessment of a driver of the arriving vehicle, which indicates skill level of the driver in performing parking maneuver(s). The method dynamically defines, based on the dimension(s) of the arriving vehicle and the obtained skills assessment, a parking space in an unoccupied area within the parking area. The defining includes selecting dimensions of the dynamically defined parking space. The method directs the arriving vehicle to the dynamically defined parking space, the directing including providing live parking guidance to facilitate maneuvering the arriving vehicle into position in the dynamically defined parking space.

Further, a computer program product including a computer readable storage medium readable by a processor and storing instructions for execution by the processor is provided for performing a method. The method performs an automated measurement of dimension(s) of an arriving vehicle arriving at a parking area. The method obtains a skills assessment of a driver of the arriving vehicle, which indicates skill level of the driver in performing parking maneuver(s). The method dynamically defines, based on the dimension(s) of the arriving vehicle and the obtained skills assessment, a parking space in an unoccupied area within the parking area. The defining includes selecting dimensions of the dynamically defined parking space. The method directs the arriving vehicle to the dynamically defined parking space, the directing including providing live parking guidance to facilitate maneuvering the arriving vehicle into position in the dynamically defined parking space.

Yet further, a computer system is provided that includes a memory and a processor in communications with the memory, wherein the computer system is configured to perform a method. The method performs an automated measurement of dimension(s) of an arriving vehicle arriving at a parking area. The method obtains a skills assessment of a driver of the arriving vehicle, which indicates skill level of the driver in performing parking maneuver(s). The method dynamically defines, based on the dimension(s) of the arriving vehicle and the obtained skills assessment, a parking space in an unoccupied area within the parking area. The defining includes selecting dimensions of the dynamically defined parking space. The method directs the arriving vehicle to the dynamically defined parking space, the directing including providing live parking guidance to facilitate maneuvering the arriving vehicle into position in the dynamically defined parking space.

Additional features and advantages are realized through the concepts described herein.

BRIEF DESCRIPTION OF THE DRAWINGS

Aspects described herein are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
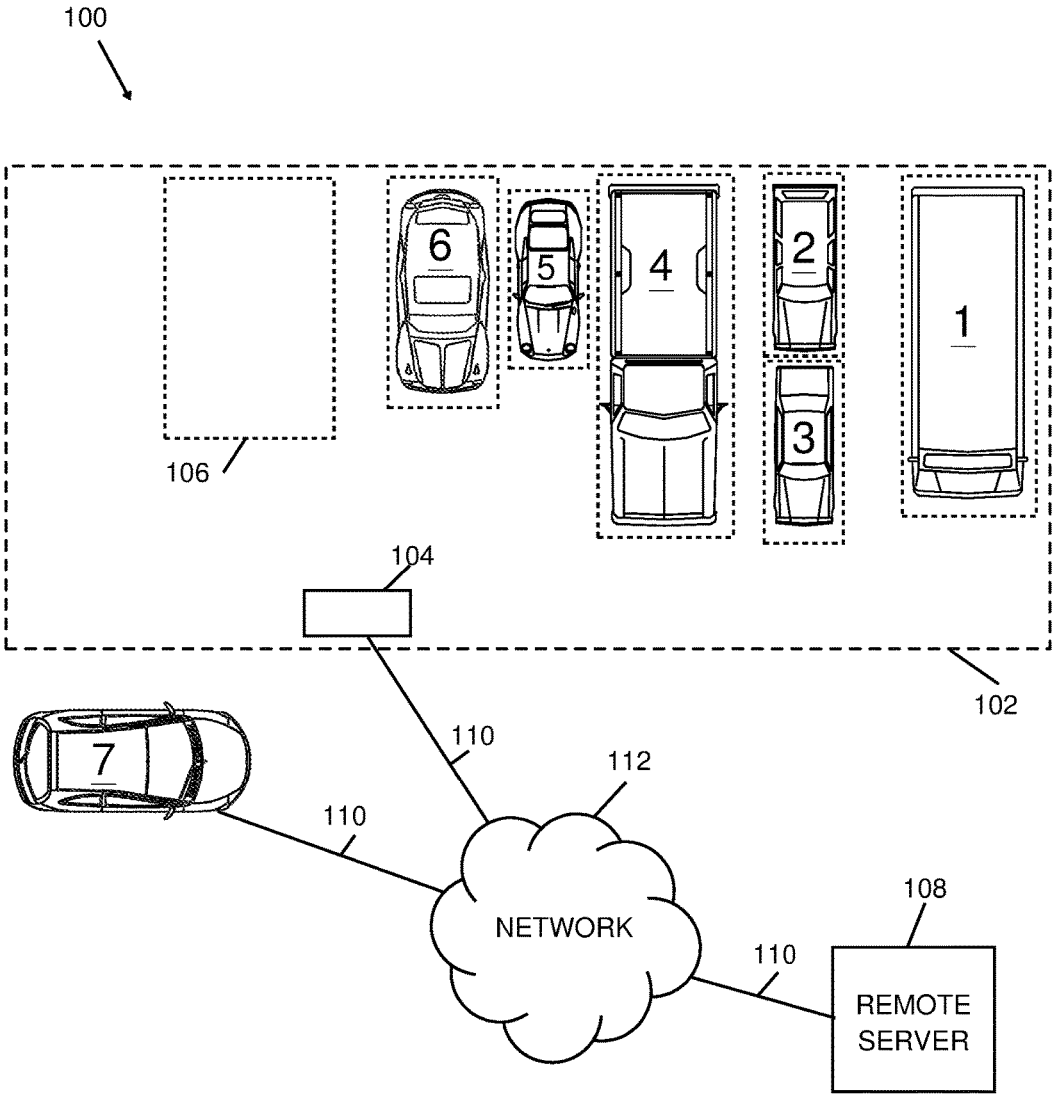
FIG. 1 depicts an example environment to incorporate and use aspects described herein.

Many of the aforementioned accidents could have been potentially halted or avoided completely through more efficient parking methods and management of space within parking garages, parking lots, and other types of parking areas. Parking a vehicle is a dangerous part of driving for many people, especially in larger cities and within busy parking areas. Parking larger vehicles (with larger blind spots) can also be extremely difficult, especially in parking garages and other tight parking areas.

As future vehicles becoming smarter, millions of existing vehicles could benefit from new ways of delivering safety features through a collective community of fellow automobile operators and network of vehicles. A vehicle network may be utilized to deliver higher safety throughout the population of vehicles while arranging and parking vehicles within a parking area.

Described herein are aspects that analyze vehicle characteristics and driver skills to determine an optimal parking spot within a parking garage or structure, or any other type of parking area. Aspects can employ a unique verification system to confirm/assess a driver's skill level for various parking maneuvers that may be utilized to safely park the vehicle. Aspects can also employ a method of dynamically displaying variable-sized parking spaces/spots using, e.g., visual indications provided by digital light projection (DLP) or other forms of lighting.

In some embodiments, drivers could agree to terms of the parking area as required upon entry into the area to park. Vehicles can share sensor data and/or video feeds streamed from the vehicle. As described in further detail herein, video from the vehicle's backup camera or any other imaging device can be shared with the system to pick-up events and information about the current parking situation within the area (obstructions, exact positioning of other vehicles, etc.). Video analytics could derive some additional information that the overall system can use to enhance the next decision(s) it makes in terms of optimizing parking space selection and directing arriving vehicle(s) to those parking spaces. Sensor data and/or video taken from or of vehicles traveling through the parking area can offer precise locations of existing objects in the area. This data can also be used in assessing driver skill level, which can be leveraged in the optimization of parking space selection as described herein.

Processing to dynamically determine parking spaces to which arriving vehicles are to be directed can leverage cognitive computing to run algorithms to optimize the parking experience within the parking area, including optimizing the selection of the space location and size, and providing live parking guidance to assist the drivers in maneuvering both to their respective parking spaces and positioning/parking the vehicle in those spaces. By way of a specific example to illustrate, the type of the arriving vehicle can dictate what size space is needed to accommodate the vehicle, as well as what route to take to that space, how to safely orient the vehicle in that space and to facilitate other vehicle movement through the parking area, where to position that space in the parking area, and other selections. A full size pickup truck may be better positioned in or near a corner of the parking area relatively far from the entrance/exit because a larger pickup truck poses a larger obstruction to the ingress and egress by other vehicles. The pickup truck may also necessitate a much larger parking space than a motorcycle or compact vehicle. Additionally, if two large pickup trucks are already parked near each other with a relatively small space between them, it may be desired to utilize that small space for a compact vehicle instead of another large vehicle, or direct, if required to park there, direct the larger vehicle to back into the space for easier egress. In this manner, aspects can focus of optimization in terms of selection of the parking space and facilitating ease of ingress to and egress from the parking area, for instance by emphasizing safe and efficient vehicle movement through the parking area.

In some aspects, live parking guidance may be provided to the vehicles as they enter and traverse the parking area on their way to the dynamically defined parking space. The live guidance may include directions on how to proceed while within the garage—for example: "Please proceed to Level #4, Space #253 is available, now reserved and optimized for your size vehicle." Space 253 may be dynamically defined and indicated on-demand, e.g. by visual indicators such as lighting. The live parking guidance may also assist the drivers in approaching the parking space and in parking/positioning the vehicle in that parking space. Example live parking guidance includes audio and/or visual commands or cues, which may be provided through the vehicle's entertainment system (radio, speakers, dash-navigation, etc.) and/or by external devices provided by the parking areas, such as signs, lights, and audio cues, as examples. Both future and existing vehicles can benefit from these aspects. Newer or to-be-developed autonomous cars might park themselves after receiving commands from the system regarding the location and other information about the defined parking space.

Aspects described herein are further described with the following additional examples:

Large & Small Vehicle—Parking in a Tight Space (Space Optimization):

Maneuvering a vehicle in a tight space to park the vehicle can be a difficult task for many people. Fitting a larger vehicle into a tight space can be problematic and present the potential for an accident to occur. Drivers can make mistakes and misjudge object size, position, and distance. Distractions and other factors can also affect a driver's ability to maneuver the vehicle.

In accordance with aspects described herein, the system could direct a driver of an arriving vehicle where to park the vehicle such that there is ample of space—free of objects, other cars, people, and optimized in real time. This direction could be effected by providing information to a computer system of the arriving vehicle or of the driver, or by causing devices installed in the parking area to direct the driver to the parking space. The driver could be directed to the best option for parking their large or small vehicle as the case may be.

In an example scenario, an arriving, relatively large vehicle approaches and enters the parking area (e.g. through a gate or other entrance to a parking garage) to park the larger vehicle. A system described herein learns of available sensors, size, and other characteristics of the vehicle upon the vehicle's entrance into the garage. The system could have sensors, readers, and/or other devices to measure length, height, and other characteristics of the vehicle as it enters. The arriving vehicle could convey that data to the system and the system could optionally separately scan, reads, or monitor the arriving vehicle to obtain its own data about the vehicle characteristics, then compare that to the data conveyed by the arriving vehicle. In this regard, some vehicles could have a transmitting mechanism to transmit data to the system that indicates length and other information about the arriving vehicle. This information could then optionally be verified separately by the system, which could be useful in situations where the vehicle characteristics have been at least temporarily modified (e.g. added roof rack, bike rack, towing a trailer, etc.). With the shared and/or obtained data about the arriving vehicle and current status of the parking area in terms of occupied areas, obstructions, current arrangement of vehicles, and any other pertinent information, a cognitive system driven by an analytics platform (as one example) can take relevant data points into account, dynamically define a parking space, and deliver recommended parking space instructions through audio and/or video communications within, and potentially outside of, the vehicle.

It is noted that aspects can also apply to motorcycles and any other type of vehicles—motorized and non-motorized—because the system considers size of the arriving vehicle in its planning. This approach would allow for motorcycles & mopeds to be included, where they have reduced space size requirements and potentially other characteristics in terms of their maneuverability around the parking area and ability to traverse areas that larger vehicles could not.

Airport Parking Garage Optimization (Time Optimization):

Throughout airports worldwide, there are long term and short term parking garages. This presents another opportunity for optimizing the parking experience based on a driver's current requirements.

In an example scenario, the arriving vehicle would "ask" how long the driver plans for the vehicle to remain parked within the garage. This can be accomplished via audio query/input and/or a smartphone or other mobile device within close proximity (e.g. within the vehicle). The driver could input or provide an expected or anticipated duration of time (an hour, a day, 2 weeks, etc.) the vehicle is to remain within the garage. The system can take this understanding about how long vehicles are likely to remain within the garage into account when making cognitive decisions about vehicle placement. Vehicles may be arranged and their space definition optimized in different ways based on the length of their expected stay within the garage. For instance, the system might define parking spaces for large vehicles that will remain for a relatively long duration of time on the upper level(s) of the garage so that they remain out of the way of more active vehicles like ones that come and go relatively frequently. The system may define parking spaces for these more active vehicles on lower level(s) so there is overall less traffic flow through the garage.

Stress Level Reduction Through Reservation System (Space Availability Optimization)

Some drivers become uncomfortable when parking their vehicle. This feeling, along with competition for a space that the driver may experience against other drivers, might cause the driver to be less efficient in terms of space selection and time spent parking. A driver facing pressure from another driver or by the parking situation generally may cause the driver to detour to avoid certain vacant parking space(s) intentionally if the driver is not confident with such a parking approach and/or is nervous to compete for a particular parking space when other driver(s) are nearby. This would result in a lost opportunity and lost productivity by the driver and the parking garage. Also, stress levels might elevate as people compete for parking spaces, presenting potential safety issues. Parking accidents may occur at a higher rate in these types of situations.

The system can reserve from the available unoccupied space in the parking area a dynamically defined parking space optimized for the driver and the driver's vehicle as a driver enters the garage. The system can provide clear direction through new features as part of vehicles and parking applications for phones or other mobile devices, enabling people to safely park their vehicle with a much lower stress level, knowing their space has been reserved. Each vehicle could have a reserved, space, well defined for the vehicle and tailored to vehicle size and dimension. A driver using this application could proceed to (optionally based on live guidance provided to the vehicle) the defined parking space via this method to safely park their vehicle. This method would yield lower stress through space availability optimization and control.

Accordingly, in some aspects, measurements of an arriving vehicle are taken to obtain data on various vehicle characteristics. By way of example, a system described herein can measure the arriving vehicle as it enters the parking area and can determine whether the vehicle has a car-top carrier or a bike rack on the back (or any other item(s) that make the vehicle dimensionally larger than a "standard" vehicle or than the vehicle when it does not include such add-ons). A customized solution in terms of a parking space that is dynamically defined is then provided for each unique arriving vehicle.

As described herein, a driver skill level for performing parking and other driving maneuvers may be assessed/verified as the vehicle enters the parking area. The driver's skill level may be indicated in an obtained driver profile, and/or ascertained by analyzing in real-time the driver's current driving ability. A real-time assessment gives a more accurate reflection of driver skill in the particular situation presented. This may be done by directing a driver along a path and observing via sensor and/or video input how adeptly the driver follows the path and maneuvers the vehicle through the parking area. This may be done in a more open space, for instance a skills assessment area of the parking area (or outside of the parking area), to verify if the driver has the skills that the driver purportedly has based on the obtained driver profile. In other examples no such profile is provided, and the driver's skills are assessed purely based on observing the driver as the driver proceeds to or through the parking area or portion thereof. Driver skills and ability can change if a person is driving a different vehicle than normal (e.g. a rental car or a friend's car), if the driver's ability is impaired, and so on, making a dynamic and real-time assessment potentially more valuable than a prior assessment obtained from a profile or from a prior assessment done by the system for the vehicle or current driver. In some aspects, driver skill level is assessed though video analysis of video obtained of the vehicle as the vehicle proceeds to an initial parking space. Additionally or alternatively, it could be assessed at least partially when the driver attempts to park the vehicle in an initial space. Several forward-reverse maneuvers might imply that the particular space is not suited for this driver's ability, i.e. deficiency in the driver's ability in maneuvering into the space. The system could then dynamically reassess based on the additional information pertaining to the driver's ability, and direct the driver to another dynamically defined parking space—one that is more suited to the driver's ability to maneuver the vehicle. As noted, additionally or alternatively, there may be a skill test area for skills verification that directs the driver to perform parking maneuvers such as backing-up, turning, pulling into a defined area, and so forth.

Because the parking spaces are dynamically defined, which includes dynamic selection of size, location, orientation, etc., traditional staticized definition of parking spaces, for instance by way of paint-lines, need not be present in the parking area. Spaces may be widened or narrowed based on a variety of factors, which may include a driver's skill and vehicle characteristics.

FIG. 1 depicts an example environment to incorporate and use aspects described herein. Environment 100 includes parking area 102 in which vehicles labeled 1 through 6 are currently parked. 'Parking area' can refer to the physical surface on which vehicles park together with the general environment (e.g. infrastructure of a parking garage) in which the vehicles park.

Installed in the parking area 102 are one or more devices 104, such as one or more computer systems, sensors, scanners, electronic readers, lights, projectors, and/or cameras. Devices 104 are coupled to and in communication with a network 112 via communications link 110, as is a remote server 108 and an arriving vehicle labeled 7. In some examples, a device 104 is a computer system to which the other devices are coupled, perhaps as peripherals devices of the computer system.

Network 112 may include any one or more networks, such as one or more local area networks and/or one or more wide area networks, such as the internet. Accordingly, remote server 108 may be located anywhere, such as in a location remote from the parking area (e.g. a cloud computing facility) or in the parking area itself, as examples.

In some examples, vehicle 7 includes or is associated with a computer system that is connected to network 112 via a wireless communication link 110, such as a cellular, Wi-Fi, or other type of wireless connection. More generally, communications links 110 may be any appropriate wireless or wired communication link for communicating data. In some embodiments, connectivity of vehicle 7 to network 112 is made by proxy via a user's mobile device. For instance, a mobile device, such as a smartphone, of an occupant of vehicle 7 is connected to network 112 via a cellular or Wi-Fi connection, as examples. Additionally, one or more of vehicles 1-6 may also be in communication with remote server via network 112 or another network.

FIG. 1 depicts arrival of arriving vehicle 7 to be positioned in the parking area 102. One or more devices 104 acquire vehicle characteristics of arriving vehicle 7 though any appropriate means. In one example, the vehicle is scanned using sensors, scanners, readers, cameras or similar device(s) 104 to acquire information about the vehicle. Additionally or alternatively, one or more devices 104 acquire data from the arriving vehicle (e.g. a computer system thereof or an occupant of the vehicle) with the vehicle characteristics and one or more other devices 104 verify vehicle characteristics, such as vehicle dimension. Device(s) 104 provide acquired data to remote server 108 through network 112. Additionally or alternatively, vehicle characteristics are provided to remote server 108 by vehicle 7 itself through network 112.

Accordingly, vehicle characteristics such as vehicle dimension are acquired by devices 104 and/or are sent from the arriving vehicle 7 (computer system associated therewith, such as a smartphone of an occupant) to remote server 108 via network 112. The vehicle characteristics include any appropriate information about the vehicle that might help remote server 108 in the optimization of the parking space definition for arriving vehicles. Such information includes, as examples, vehicle dimension (e.g. dimensions of the vehicle, footprint, shape, etc., as examples examples), add-ons, sensors, and guidance-assist features of the vehicle.

The example of FIG. 1 depicts a current arrangement of the vehicles 1 through 6 in the parking area. The dashed lines surrounding each vehicle 1 through 6 represents the parking space dynamically defined for that vehicle. Several features described in further detail herein are illustrated. For instance, it is seen that relatively large vehicles 1 and 4 are positioned generally away from the entrance to the parking area (where arriving vehicle 7 is currently positioned). Additionally, relatively large areas of space are allotted surrounding vehicles 1 and 4 (between their dynamically defined space and adjacent dynamically defined spaces) to allow for the relatively wide turns that larger vehicles make. It is also seen that they are oriented so that they may easily pull forward to exit their parking spaces. In this example, relatively small vehicles 2 and 3 have been positioned between large vehicles 1 and 4. The dynamically defined parking spaces for vehicles 2 and 3 are small compared to the space between vehicles 1 and 4. Clearly smaller vehicles 2 and 3 do not require so much space to adequately maneuver, but positioning them in this larger area consumes space that might otherwise go unused, while allowing enough space for vehicles 1 and 3 to pull out and turn. It also enables double-parking of the vehicles 2 and 3. In this regard, the anticipated length of time that a vehicle is to remained parked in the parking area may be taken into account, and in this example, it is anticipated that vehicle 3 will depart the parking area earlier than vehicle 2. Vehicle 2 can be boxed-in for the time being to more efficiently use the parking area space. Vehicle 6 in this example belongs to a highly-skilled driver who can easily maneuver into and out of its parking space.

Aspects described herein dynamically define a parking space for arriving vehicle 7, the area being depicted as area 106 in FIG. 1. In one example, information about the vehicle 7 and driver is obtained as the vehicle arrives at the parking area. That information could vehicle characteristics. Additional information that may be acquired includes information about driver skill level to perform maneuvers. In some examples, the driver is directed to a skills assessment area for the system to observe the vehicle (e.g. via devices 104) in performing various maneuvers in order to assess the driver's skill level. In this particular example, the skill level of the driver of vehicle 7 is known to be and/or is assessed in real-time to be relatively low, meaning the driver has difficulty performing even elementary parking maneuvers. Consequently, the system (e.g. remote system performing processing to dynamically define a parking space for arriving vehicle 7) has determined to position parking space 106 relatively far away from vehicle 6 and its parking space in order to make it easier for vehicle 7 to pull into its space and to reduce the risk that vehicle 7 will strike another vehicle on account of the driver's poor driving skills. Additionally, the size of parking space 106 is relatively large compared to the size of vehicle 7, which provides additional buffer surrounding the vehicle.

In an embodiment, a method is provided to analyze vehicle characteristics and determine an optimal parking location. In this method, the arriving vehicle communicates with the parking structure (e.g. device(s) 104) via a wireless protocol, such as Wi-Fi. Additionally or alternatively, device(s) 104 include one or more scanners at the point of entrance that collect information on modifications to the standard vehicle metrics. For older vehicles that may not have the capability to transmit vehicle characteristics to a receiving-device, the scan may be the only means of identifying vehicle characteristics.

An example modification is a trailer, car top carrier, or bike rack attached to the arriving vehicle, which would change the default dimensions of the vehicle. The vehicle may not be aware of such modifications and may convey the default dimensions instead, which would mislead the system in terms of the actual dimensions of the vehicle at the time of arrival.

Another component of this embodiment is analysis that takes place to determine the optimal parking space for the arriving vehicle. Since only unoccupied areas within the parking area may be considered candidate locations for a parking space for the arriving vehicle, the system, which may include remote server 108 and devices 104, could be aware of which areas within parking area 102 are occupied and the characteristics of the vehicles occupying those areas.

The following is a list of example characteristics that may be identified for one or more vehicles parked and/or to be parked in the parking area:

- Vehicle dimensions, include width, length and height
- Intended length of stay
- Driver skill with the following procedures or maneuvers: parallel parking, backing-in, pulling-in, backing-out
- Vehicle features including: availability of backup camera, backup sensors, 360-degree camera, cross traffic detection sensors, wheel base/turning radius. These features provide assistances that can be provided to the driver to guide them. It might be more difficult for even a skilled driver to back into a space without the sensors. Knowledge about whether these features exist on the vehicle can inform how likely it is that a driver will successfully maneuver into a given space. Regarding wheel base/turning radius, this may be determined based on a determination of the type of tires installed on the vehicle, which can be ascertained by imaging the tires and analyzing them to identify tire size, type, etc.

Wheel base of a vehicle can indicate dimension and overall maneuverability, and turning radius of a vehicle indicates how tightly the vehicle can turn, both of which may be important in assessing the ease of maneuvering the vehicle within an area.

Figure 2:
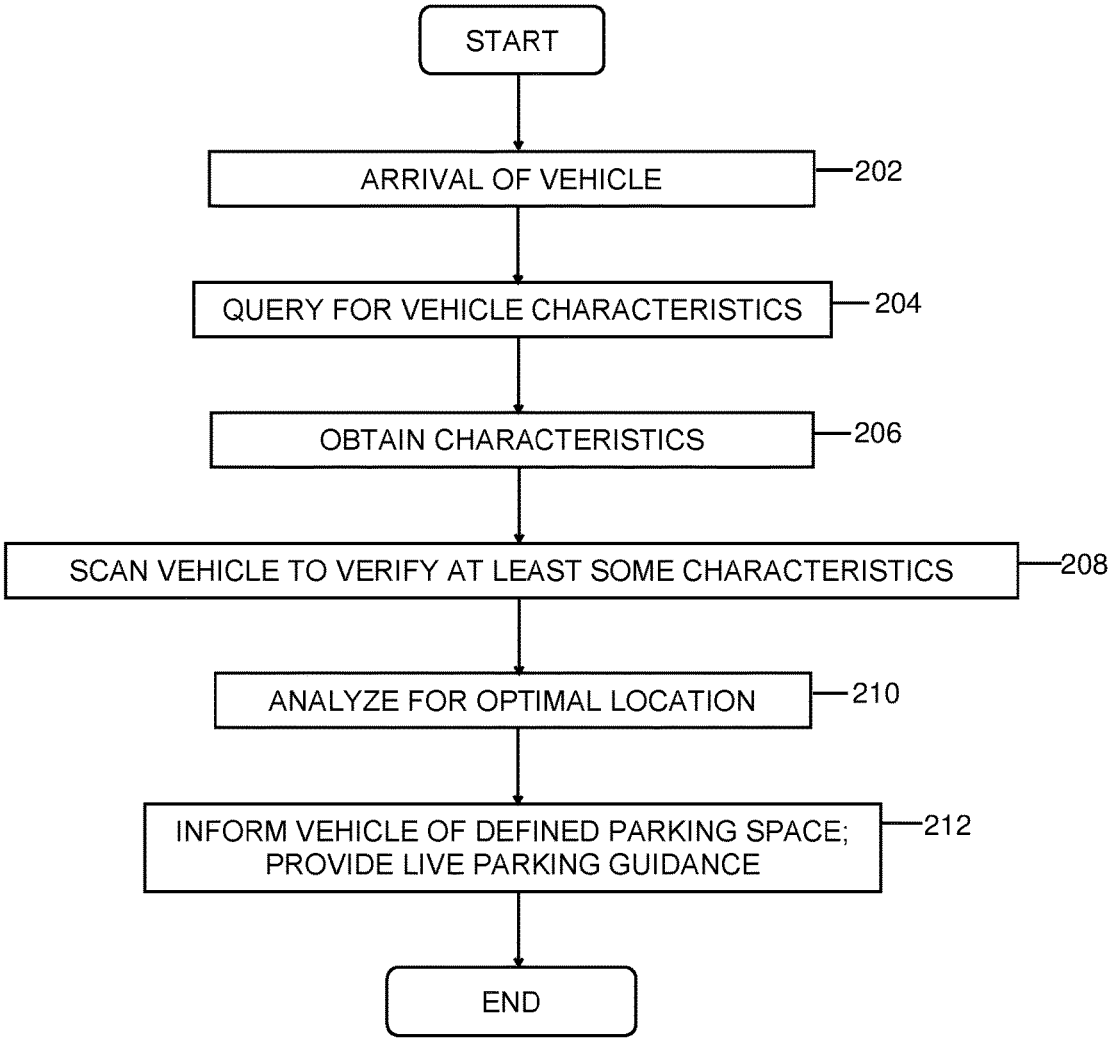
FIG. 2 depicts an example method to analyze vehicle characteristics and determine an optimal parking location, in accordance with aspects described herein.

FIG. 2 depicts an example method to analyze vehicle characteristics and determine an optimal parking location, in accordance with aspects described herein. One of more aspects of the method of FIG. 2 may be performed by or in conjunction with a computer system. Initially, the driver pulls the arriving vehicle into a parking garage (202) at which point a device at the parking entry point queries the vehicle for vehicle characteristics (204). The vehicle responds with, and the device obtains, characteristics that may include one or more of the above, or any other characteristics (206). A device at the parking entry point also scans the vehicle (208) for any modifications to what was obtained at 206. A vehicle parking system (VPS), such as a remote server that acquires the aforementioned characteristics in the form of data from the device(s) at the parking garage, then analyzes the optimal location (210). Specifically, the VPS can maintain knowledge of a current inventory of open parking space/spaces. Based on known factors regarding the arriving vehicle, the optimum space is dynamically defined and assigned to the vehicle. Thus, these aspects consider existing vacant space in the parking area and select from that vacant space a parking space to park the vehicle. Factored into the dynamic determination may be: a list of characteristics as mentioned above; recommended way to position or orient the vehicle within the parking space—large or small vehicle, back-in vs. pull-in. etc.; consideration of 'double' spaces for long wheel base vehicles; and consideration of pairing relatively large and relatively small vehicles across the aisle from each other.

Once the parking space (location, size, etc.) and other parameters of the parking recommendation are dynamically defined/determined, the system informs the vehicle and driver of the assigned location and recommendations (212) (such as a recommendation to pull into the spot or back into the spot). As part of this, various options can be utilized to provide live parking guidance to the driver, including audible notification and/or navigation screen notification.

In another embodiment, a method is provided to determine or verify driver skills before directing the driver and vehicle to the assigned parking space. One aspect of the method is the proper assessment of the skill(s) of the driver maneuvering the arriving vehicle. Certain portions of the parking area may be omitted from consideration for the dynamically defined parking space if the driver does not possess the appropriate skill-set to properly and safely navigate the vehicle into the defined space. By providing a defined assessment of the driver's skills, the VPS can ensure that the driver can safely park the vehicle, for instance in challenging situations that might include backing into a parking space or parallel parking.

Figure 3:
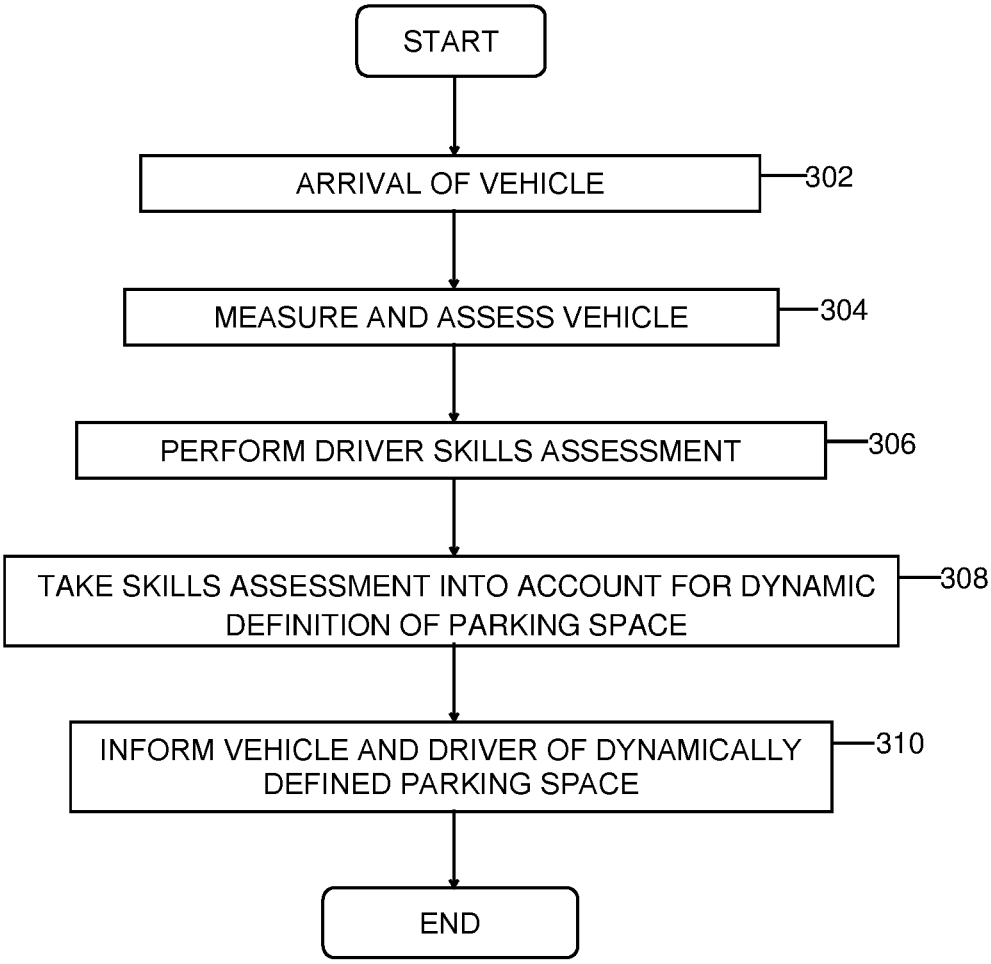
FIG. 3 depicts an example method to determine or verify driver skills before directing to the assigned parking space, in accordance with aspects described herein.

FIG. 3 depicts an example method to determine or verify driver skills before directing to the assigned parking space, in accordance with aspects described herein. One of more aspects of the method of FIG. 3 may be performed by or in conjunction with a computer system. Initially, the driver pulls the arriving vehicle into a parking garage (302). The vehicle is then measured and assessed (304), for instance as described in aspects above with reference to FIG. 2. The VPS then assesses the skills of the driver (306). As an example, a skills test is performed, wherein the system instructs the driver to proceed to a skill test area for skill(s) verification on demand and devices observe the vehicle during the test. The skill test can assess any appropriate skills/maneuvers, such as (but not limited to): parallel parking skill, rear facing parking and backing into a space skill, and/or tight turning radius parking skill. Once the skill test has been completed, the VPS takes the assessment, which may indicate pass or failure of each skill or collectively, into account for the driver and vehicle in question (308). This may factor into what is ultimately determined to be the defined parking space for the arriving vehicle. The process then informs the vehicle & driver of the parking space that has been dynamically defined given the vehicle characteristics and driver skill (310).

Additionally or alternatively, the system can observe the driver maneuvering to or into an initially-selected parking space and redirect the driver to a different parking space if the initially-selected space is determined to be sub-optimal based on the observation. The initial space may be considered sub-optimal if it is observed that the driver is having too much difficulty or taking too long to park in the initial space, perhaps due to skill level of the driver as observed based on the driver maneuvering, changed position of other object/vehicles in the environment, or any other factor. Thus, the parking space initially dynamically defined (optionally based on a driver skill assessment) may be an initial parking space to which the arriving vehicle is initially directed. A method can further perform (i) observing the arriving vehicle in maneuvering to and/or into the initial parking space, (ii) determining, based on the observing, that the initial parking space is sub-optimal, (iii) based on determining that the initial parking space is sub-optimal, dynamically defining a different parking space (perhaps by re-performing aspects of processes described herein, such as FIG. 2) in another unoccupied area within the parking area, and (iv) redirecting the arriving vehicle to the dynamically defined different parking space, which redirecting can include providing live guidance to direct the driver to the different parking space.

In another embodiment, a method is provided to dynamically display parking spaces using digital light projection or light emitting diodes. The dynamic definition of an appropriate parking space can take into account the space needed, considered vehicle dimension plus buffer based on the driver skill testing results from above (FIG. 3), accounting for the driver offset.

Using light to physical delineate the dynamically defined parking spaces and location may be useful at least due to the dynamic nature of each parking situation. Valuable space in the parking area may be misused and/or wasted when the parking area is constrained with traditional, predefined, premeasured parking spaces delineated with painted lines. According to aspects described herein, dynamic digital light projection (or any other form of visual demarcation on the surface of the parking area) replaces static parking space definitions. In some aspects, one or more devices 104 are light projection devices that may be positioned and/or movable around the parking area, for instance in ceiling(s) thereof. In some embodiments, the digital light is presented only during the parking procedure and only for any defined parking space(s) to which vehicle(s) are being directed at that time. In other words, for parked vehicles, the respective spaces need not remain delineated with light, though they may be in some embodiments and/or spaces nearby another space that is actively being lit for an approaching vehicle to be parked may be indicated. The light projection can delineate the boundaries of the defined parking space until any appropriate time, for instance when the driver successfully maneuvers the vehicle into position, when the driver turns off the vehicle, when the driver exits the vehicle, or for a duration of time after any of the foregoing, as examples.

An advantage is that parking areas need not have painted or other static space definitions. This saves resources otherwise dedicated to, e.g., paint and labor, and upkeep. Additionally, it enables the size and number of spaces dedicated for special use, such as handicapped, visitor, VIP, or other 'reserved' parking uses, to be dynamically increased or decreased based on the current requirements or capacity of vehicles within the garage. Further in this regard, a special use status of the vehicle (handicapped occupants, visitor, VIP, etc.) may be conveyed as another characteristic that may be taken into account in the dynamic definition of an appropriate parking space for the vehicle. This status can, for instance, inform additional parameters for the parking space, for example that the space should be located on the first level and/or within a certain distance of an entrance, exit, or accommodation like an elevator.

Figure 4:
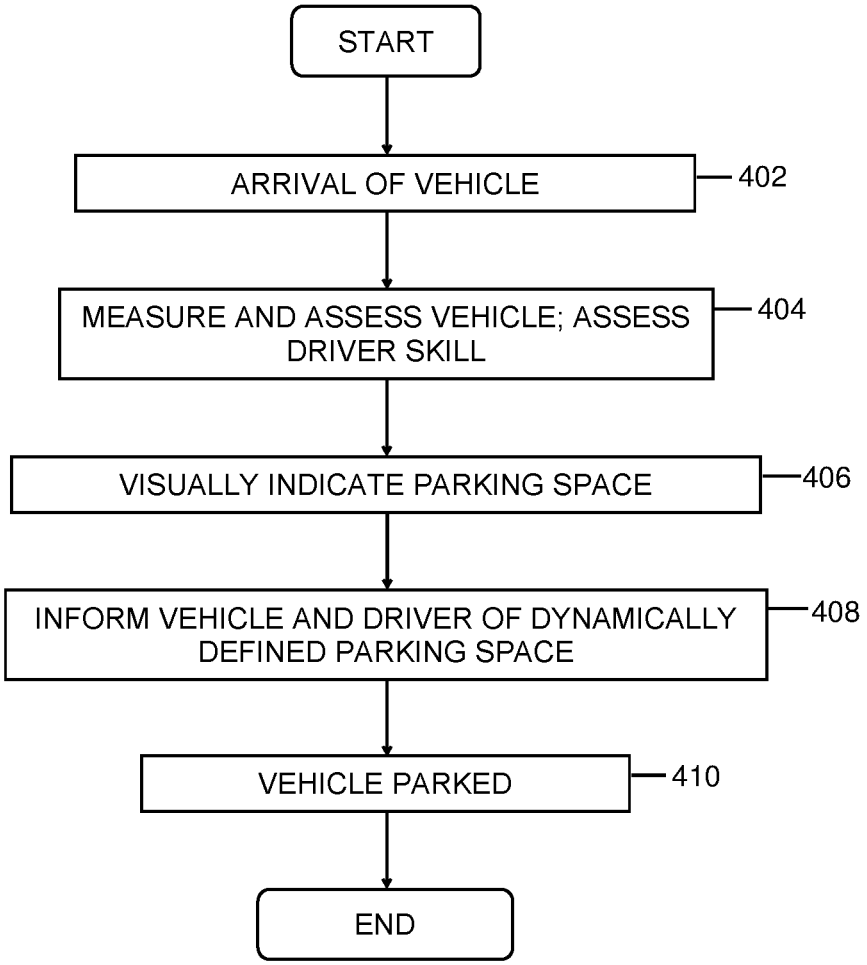
FIG. 4 depicts an example method to dynamically display parking spaces using digital light projection or LEDs in accordance with aspects described herein.

FIG. 4 depicts an example method to dynamically display parking spaces using digital light projection or LEDs. In some examples, LEDs are embedded within portions of the surface of the parking area. In other examples, the digital light projection is by way of lighting devices that project light onto a surface of the parking area. One or more aspects of the method of FIG. 4 may be performed by or in conjunction with a computer system. Initially, the driver pulls the arriving vehicle into a parking garage (402). The VPS then measures and assesses the vehicle (e.g. FIG. 2) and assesses driver skills (e.g. FIG. 3) (404). Once the parking space is defined, the VPS uses lighting devices, which may be devices of the VPS or separate devices with which the VPS communicates, to visually indicate the parking space on the surface of the parking area for the driver (406). As an example, projectors are fixed to the parking garage ceiling to digitally project the light onto to ground when and where appropriate. The projectors could be adjoined to a matrix grid on the ceiling that allows them to quickly move at high speed to the appropriate location to project the digital light where appropriate. As another example, a collection of light emitting diode (LED) devices are installed in/on the surface of the parking area and the appropriate ones are illuminated to delineate the parking space for the driver. The process also informs the vehicle and driver of the assigned parking space (408). As noted, the visual indication of the parking space, for example the digital light projection, may, in some embodiments, be provided only while the parking procedure is in process. Parking procedure in this context refers to the driver maneuvering the vehicle through the parking area to the location of the parking space and maneuvering the vehicle into that parking space. Accordingly, the vehicle is parked (410) and thereafter, in the case of projectors, they may be repositioned to assist another driver.

Accordingly, a cognitive approach is provided for defined space optimization of the available parking and empty space factoring and application thereof. It can optimize use of available space based on a unique set of parameters pertaining to the vehicles and drivers of each situation. It can identify parking parameters for each driver and vehicle and optimize the space and experience level for each individual user. This can maximize efficiencies for both the space the driver's vehicle occupies and the expected time the space will be needed.

Aspects further provide a holistic parking solution approach designed to optimize the parking location searching process, vehicle size definition, optimization factors, and navigation to the final physical location for parking. The system can find or define the parking space specifically for the arriving vehicle/driver combination. The driver does not need to select a parking space; it is selected for the driver and the driver is guided to that space. Further, the system not only locates a space for the vehicle but it dynamically defines it, meaning there need not be any pre-definition of the space in terms of size, location and orientation. The dynamic definition may be based on skill level of the driver that is be determined based on, e.g. a driving test.

The dynamic definition may be based on verified, overall size, dimensions, and other characteristics of the vehicle. A multi-step approach may be provided in this regard, in which vehicle size information and information about other vehicle characteristics is initially received from the vehicle, and a scan with laser or video analytics (as examples), or other form of verification of those characteristics, is performed.

Automobile manufactures, parking area builders, and stakeholders of global public automotive safety may leverage aspects described herein. Furthermore, an analytics platform could potentially be used to cognitively hone traffic accident data within parking areas. Ultimately, new parking areas could be designed to provide aspects described herein.

Cognitive parking methods described herein may be delivered through mobile vehicle application(s) that enable sharing of data through network(s) of client device(s) and vehicles on-request/on-demand. An analytics system can cognitively use data points (size of vehicles, length of stay, space availability, etc.) to determine the best location to optimize the parking of the vehicle, thus optimizing the parking area utilization and personal user experience for the driver. It is noted that while the system may initially and optionally be programmed with some rules or guidelines for optimizing parking area utilization and dynamically defining parking spaces, analytics and system learning enable the system to adapt and become more intelligent over time, informing improved optimization processing and algorithms. A parking area becomes a changing ecosphere of moving vehicles, humans walking to vehicles, and optimized space, controlled by an analytics system via cognitive methods for space management.

Sharing data, a cognitive system driven by an analytics system can take all relevant data points into account and deliver a recommended parking space instructions through audio or other communications within the vehicle.

Garages and other parking areas could potentially be redesigned to no longer have fixed-size parking spaces but rather variable-size spaces, dynamically defined and positioned, based upon different sizes of vehicles within the garage at any point in time.

The system can also accommodate driverless/autonomous vehicles, providing directives to an autonomous vehicle for parking in the correct location. For vehicles with drivers, LED, DLP, or other lighting devices can turn on and off to define dynamically changing lanes & parking lines within the garage.

Figure 5:
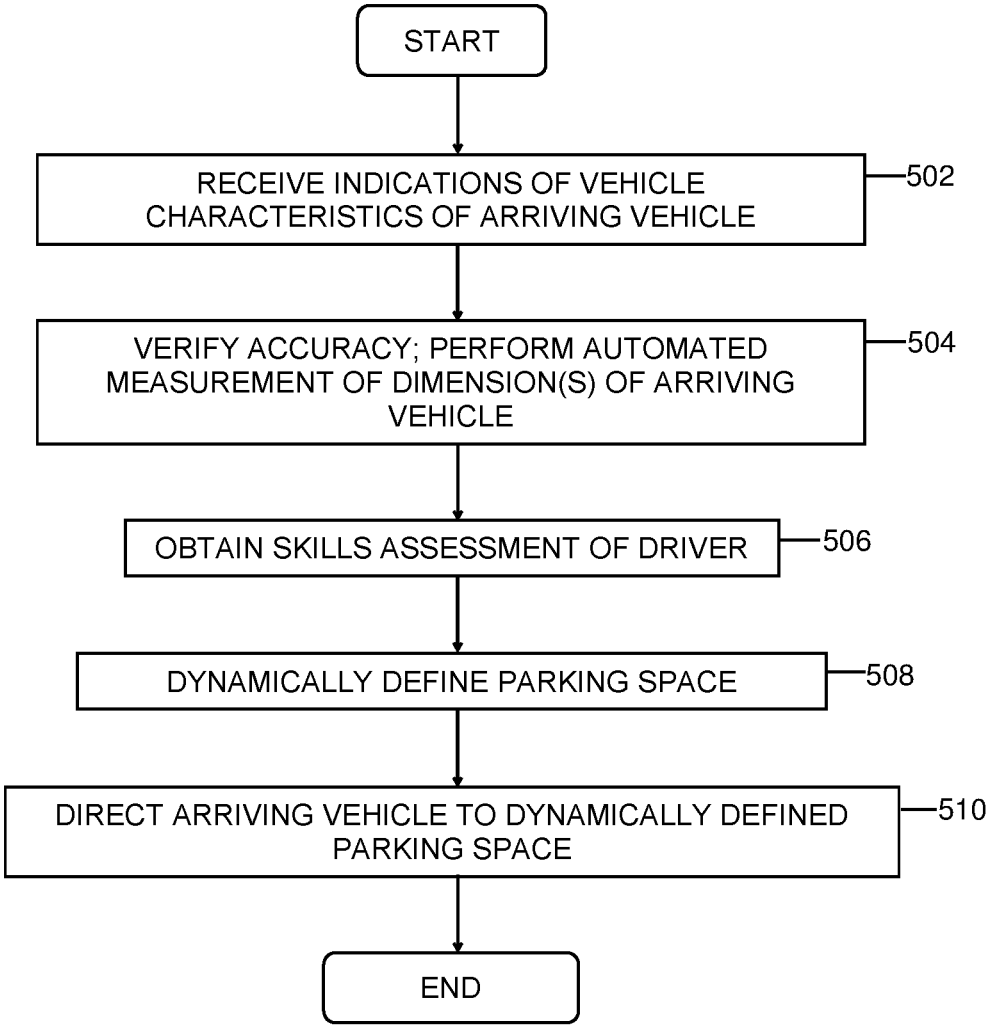
FIG. 5 depicts an example process for dynamic parking space definition, in accordance with aspects described herein.

FIG. 5 depicts an example process for dynamic parking space definition, in accordance with aspects described herein. In some examples, the process is performed by software installed on one or more computer systems, such as those described herein, which may include one or more remote or cloud servers. The process of FIG. 5 begins by receiving from an arriving vehicle arriving at a parking area and to be parked in the parking area, indications of vehicle characteristics (502), including indications of vehicle dimensions of the arriving vehicle. The process then verifies accuracy of the indicated vehicle dimensions (504), for instance by performing an automated measurement of at least one dimension of the arriving vehicle. The process obtains a skills assessment of a driver of the arriving vehicle (506), which skills assessment indicates skill level of the driver in performing at least one parking maneuver.

In one embodiment, obtaining the skills assessment of the driver can include dynamically assessing driver skill as the driver drives the arriving vehicle around at least a portion of the parking area and based on observing the arriving vehicle driving around the portion of the parking area. Optionally, as the driver drives toward an initially indicated parking space, the system can assess the driving for potential re-direction of the vehicle to a new dynamically defined parking space, based on the updated assessment.

Additionally or alternatively, obtaining the skills assessment of the driver includes directing the arriving vehicle to a skill test area of the parking area, and observing the driver's skill in performing the at least one parking maneuver with the arriving vehicle in the skill test area.

Continuing with FIG. 5, the process dynamically defines, based at least on the at least one dimension of the arriving vehicle and the obtained skills assessment, a parking space in an unoccupied area, within the parking area, for the arriving vehicle (508).

The defining can include selecting dimensions of the dynamically defined parking space, for instance. Selecting the dimensions of the dynamically defined parking space may be based on the skill level of the driver and an approach in which lower driver skill level results in selection of larger dimensions for the dynamically defined parking space.

In a particular example, the system obtains an indication of a type of tire installed on the arriving vehicle and ascertains a vehicle turning radius based at least in part on the indicated type of tire. The system then assesses, based at least in part on the ascertained vehicle turning radius, accessibility of one or more locations in the parking area to the arriving vehicle. In this situation, dynamically defining the parking space selects a location for the dynamically defined parking space from the one or more locations in the parking area based on the assessment of the accessibility.

The dynamically defining the parking space can include optimizing a position of the arriving vehicle in the parking area for ease of vehicle ingress to, and ease of vehicle egress from, the parking area by a plurality of vehicles. An indication of intended length of stay of the arriving vehicle in the parking area may be obtained and the optimizing the position of the arriving vehicle can account for the intended length of stay.

FIG. 5 continues by directing the arriving vehicle to the dynamically defined parking space (510). The directing can include providing live parking guidance to facilitate maneuvering the arriving vehicle into position in the dynamically defined parking space. For instance, providing the live parking guidance can include visually indicating the dynamically defined parking space in the parking area. Visually indicating the dynamically defined parking space can include using lighting devices installed in the parking area to project light onto a surface of the parking area, the projected light delineating the dynamically defined parking space.

Additionally or alternatively, providing the live parking guidance includes providing to the arriving vehicle audio-based directions to the dynamically defined parking space. Additionally or alternatively, providing the live parking guidance includes providing to the arriving vehicle a recommended parking orientation, the recommended parking orientation being a recommendation to pull forward into the dynamically defined parking space, or a recommendation to back into the dynamically defined parking space.

The vehicle characteristics can include available guidance-providing features of the arriving vehicle, such as sensors, cameras or navigation features of the vehicle. Dynamically defining the parking space can consider assistance that is potentially available from the guidance-providing features in assisting the driver in maneuvering into parking spaces. When more advanced guidance-providing features at available, the system may be more likely to recommend a space that is smaller and/or harder to maneuver into.

In some examples, the dynamically defined parking space is an initial parking space to which the arriving vehicle is initially directed. The process may further include in these situations, observing the arriving vehicle in maneuvering into the initial parking space, and determining, based on the observing, that the initial parking space is sub-optimal. This could be for various reasons, for example the driver is not skilled enough at maneuvering into the space, sensors have detected something that indicates a tighter fit than expected, or a change recently occurred in terms of the unoccupied space—for instance a car occupying a more appropriate portion of the parking area for the vehicle being parked has left the parking area. In any case, based on determining that the initial parking space is sub-optimal, the process can dynamically define a different parking space in another unoccupied area within the parking area, and re-direct the arriving vehicle to the dynamically defined different parking space.

The system can acquire information about the current state of the parking area by leveraging data from the vehicles passing through the parking area and/or sensor devices installed in or around the parking area. Thus, in some examples, the system obtains sensor data and video from vehicles driving through the parking area and analyzes the sensor data and video to ascertain location of obstruction(s) and unoccupied space in the parking area. The system can use the ascertained location of the obstruction(s) in the dynamically defining the parking space to identify a location for the dynamically defined parking space.

Although various examples are provided, variations are possible without departing from a spirit of the claimed aspects.

Figure 6:
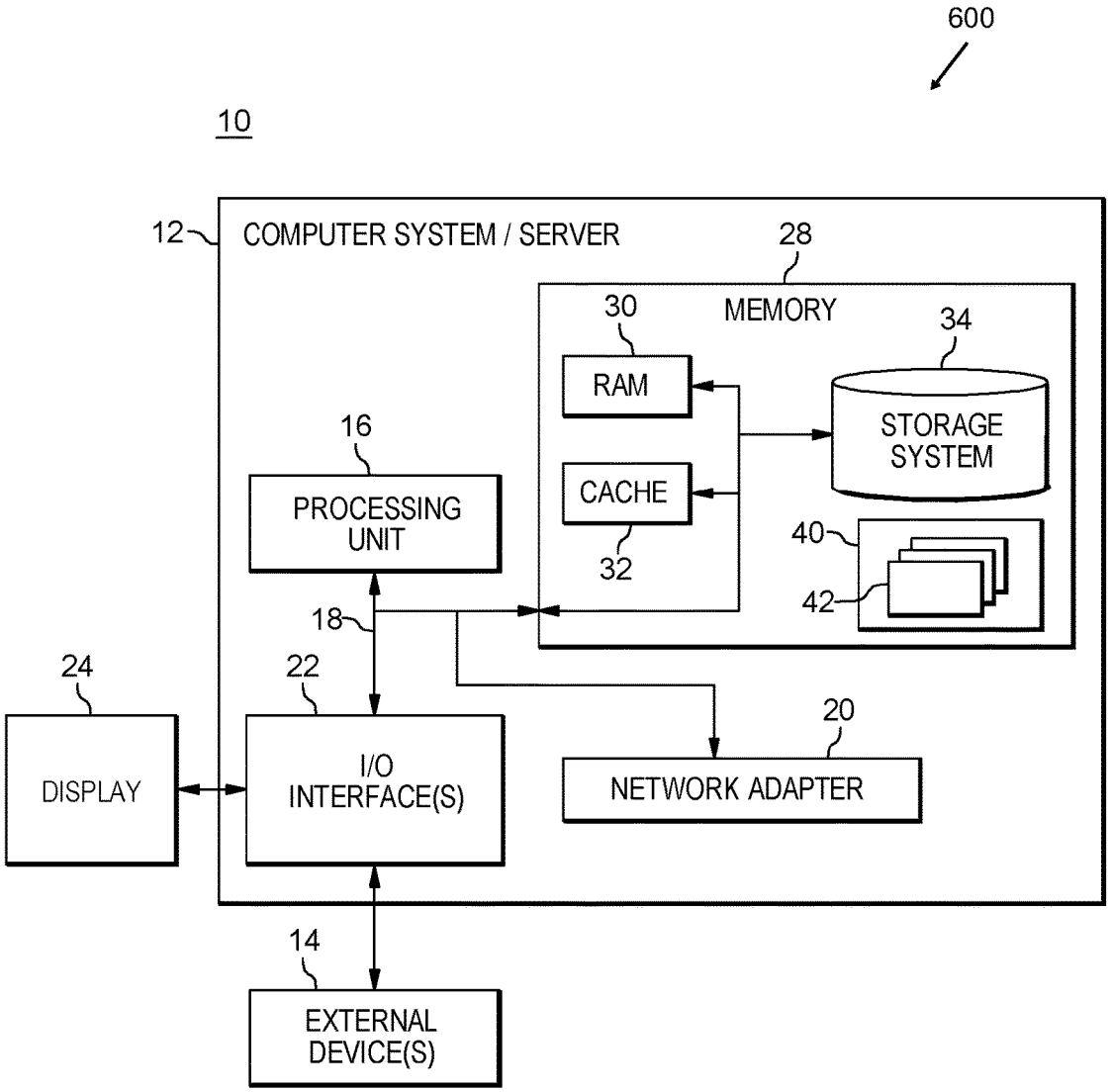
FIG. 6 depicts one example of a computer system and associated devices to incorporate and/or use aspects described herein.

Processes described herein may be performed singly or collectively by one or more computer systems, such as one or more cloud servers or backend computers (e.g. one or more social network servers). FIG. 6 depicts one example of such a computer system and associated devices to incorporate and/or use aspects described herein. A computer system may also be referred to herein as a data processing device/system or computing device/system/node, or simply a computer. The computer system may be based on one or more of various system architectures such as those offered by International Business Machines Corporation (Armonk, N.Y., USA), Intel Corporation (Santa Clara, Calif., USA), or ARM Holdings plc (Cambridge, England, United Kingdom), as examples.

As shown in FIG. 6, a computing environment 600 includes, for instance, a node 10 having, e.g., a computer system/server 12, which is operational with numerous other general purpose or special purpose computing system environments or configurations. Examples of well-known computing systems, environments, and/or configurations that may be suitable for use with computer system/server 12 include, but are not limited to, personal computer (PC) systems, server computer systems, thin clients, thick clients, workstations, laptops, handheld devices, mobile devices/computers such as smartphones, tablets, and wearable devices, multiprocessor systems, microprocessor-based systems, telephony device, network appliance (such as an edge appliance), virtualization device, storage controller set top boxes, programmable consumer electronics, smart devices, intelligent home devices, network PCs, minicomputer systems, mainframe computer systems, and distributed cloud computing environments that include any of the above systems or devices, and the like. In some examples, a computer system is incorporated into, or coupled to, a vehicle.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in many computing environments, including but not limited to, distributed cloud computing environments where tasks are performed by remote processing devices that are linked through a communications network. In a distributed cloud computing environment, program modules may be located in both local and remote computer system storage media including memory storage devices.

As shown in FIG. 6, computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media such as erasable programmable read-only memory (EPROM or Flash memory). By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments described herein.

Program/utility 40, having a set (at least one) of program modules 42, may be stored in memory 28 by way of example, and not limitation, as well as an operating system, one or more computer application programs, other program modules, and program data. Computer programs may execute to perform aspects described herein. Each of the operating system, one or more application programs, other program modules, and program data or some combination thereof, may include an implementation of a networking environment. Program modules 42 generally carry out the functions and/or methodologies of embodiments as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Input/Output (I/O) devices (including but not limited to microphones, speakers, accelerometers, gyroscopes, magnetometers, sensor devices configured to sense distance, proximity, objects, light, ambient temperature, levels of material), activity monitors, GPS devices, cameras, etc.) may be coupled to the system either directly or through I/O interfaces 22. Still yet, computer system/server 12 may be able to communicate with one or more networks such as a local area network (LAN), a general wide area network (WAN), and/or a public network (e.g., the Internet) via network adapter 20. As depicted, network adapter 20 communicates with the other components of computer system/server 12 via bus 18. Network adapter(s) may also enable the computer system to become coupled to other computer systems, storage devices, or the like through intervening private or public networks. Ethernet-based (such as Wi-Fi) interfaces and Bluetooth® adapters are just examples of the currently available types of network adapters used in computer systems.

It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

One or more aspects may relate to cloud computing.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices, for instance through a thin client interface such as a web browser (e.g., web-based email). The consumer does not manage or control the underlying cloud infrastructure including network, servers, operating systems, storage, or even individual application capabilities, with the possible exception of limited user-specific application configuration settings. In some examples, processing described can be performed by a remote server of FIG. 1 and offered as a software service available to customers, such as owners of parking areas, drivers, or other subscribers to the service.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for loadbalancing between clouds).

A cloud computing environment is service oriented with a focus on statelessness, low coupling, modularity, and semantic interoperability. At the heart of cloud computing is an infrastructure including a network of interconnected nodes. One such node is node 10 depicted in FIG. 5.

Computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

Figure 7:
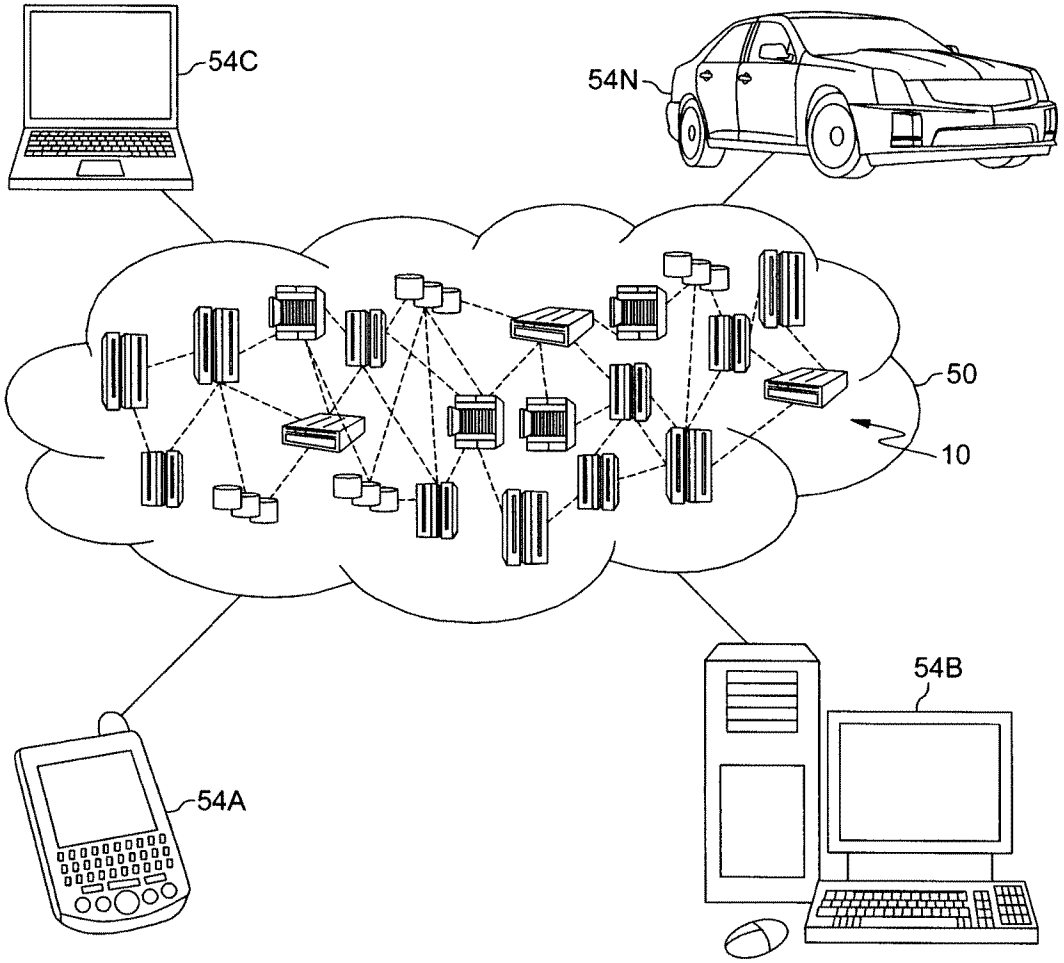
FIG. 7 depicts one embodiment of a cloud computing environment.

Referring now to FIG. 7, illustrative cloud computing environment 50 is depicted. As shown, cloud computing environment 50 includes one or more computing nodes 10 with which local computing devices used by cloud consumers, such as, for example, smartphone or other mobile device 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 6 are intended to be illustrative only and that computing nodes 10 and cloud computing environment 50 can communicate with any type of computerized device over any type of network and/or network addressable connection (e.g., using a web browser).

Figure 8:
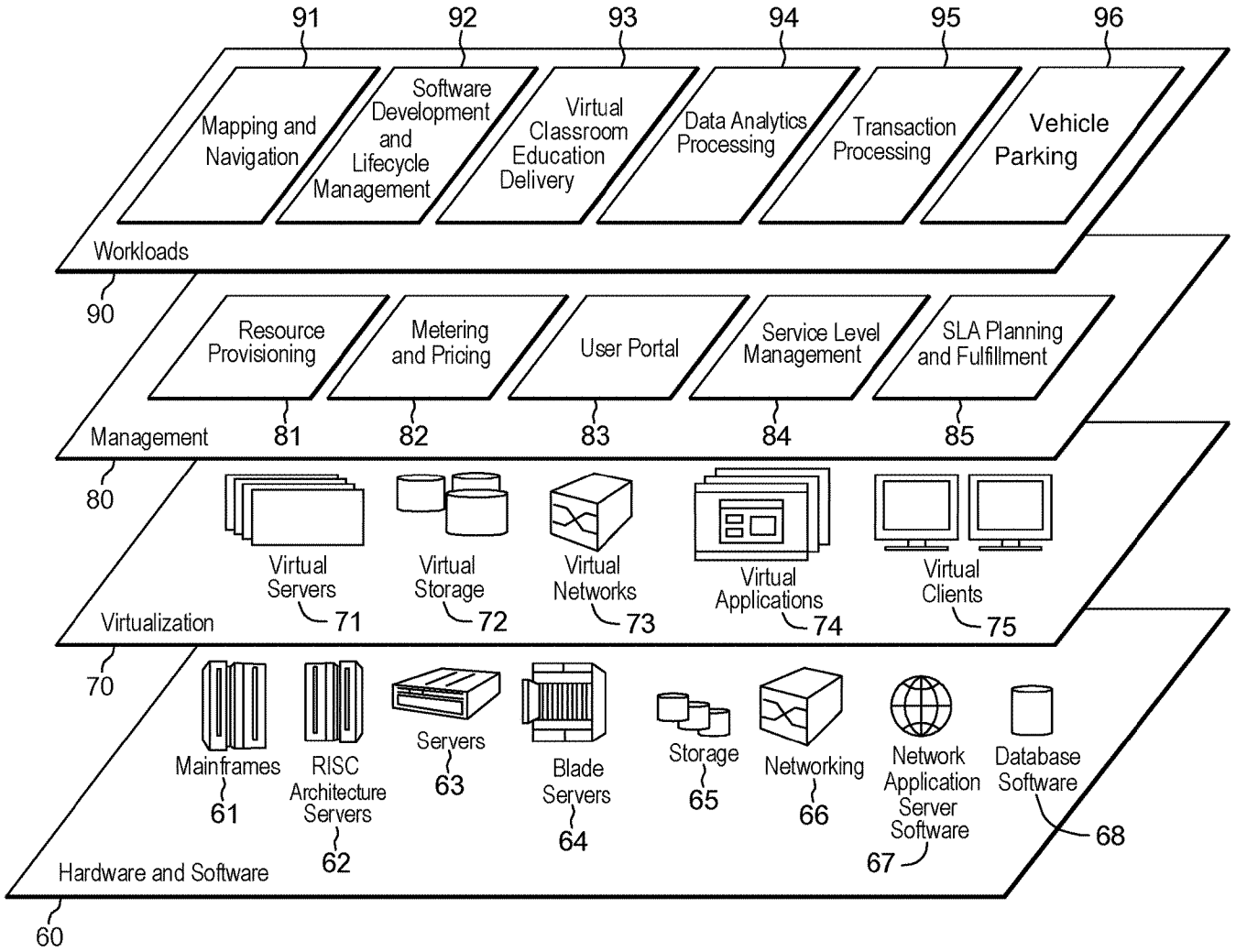
FIG. 8 depicts one example of abstraction model layers.

Referring now to FIG. 8, a set of functional abstraction layers provided by cloud computing environment 50 (FIG. 7) is shown. It should be understood in advance that the components, layers, and functions shown in FIG. 8 are intended to be illustrative only and embodiments of the invention are not limited thereto. As depicted, the following layers and corresponding functions are provided:

Hardware and software layer 60 includes hardware and software components. Examples of hardware components include mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and vehicle parking services 96 such as aspects of the VPS and dynamic definition of parking spaces described herein.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

In addition to the above, one or more aspects may be provided, offered, deployed, managed, serviced, etc. by a service provider who offers management of customer environments. For instance, the service provider can create, maintain, support, etc. computer code and/or a computer infrastructure that performs one or more aspects for one or more customers. In return, the service provider may receive payment from the customer under a subscription and/or fee agreement, as examples. Additionally or alternatively, the service provider may receive payment from the sale of advertising content to one or more third parties.

In one aspect, an application may be deployed for performing one or more embodiments. As one example, the deploying of an application comprises providing computer infrastructure operable to perform one or more embodiments.

As a further aspect, a computing infrastructure may be deployed comprising integrating computer readable code into a computing system, in which the code in combination with the computing system is capable of performing one or more embodiments.

As yet a further aspect, a process for integrating computing infrastructure comprising integrating computer readable code into a computer system may be provided. The computer system comprises a computer readable medium, in which the computer medium comprises one or more embodiments. The code in combination with the computer system is capable of performing one or more embodiments.

Although various embodiments are described above, these are only examples. For example, computing environments of other architectures can be used to incorporate and use one or more embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. A computer-implement method comprising:

performing an automated measurement of at least one dimension of an arriving vehicle arriving at a parking area, the arriving vehicle to be parked in the parking area;

obtaining a skills assessment of a driver of the arriving vehicle, the skills assessment indicating skill level of the driver in performing at least one parking maneuver;

dynamically defining a parking space in an unoccupied area within the parking area for the arriving vehicle based at least on the at least one dimension of the arriving vehicle and the obtained skills assessment, the defining comprising allocating the dynamically defined parking space in the unoccupied area, the allocating comprising choosing dimensions for the dynamically defined parking space;

directing the arriving vehicle to the dynamically defined parking space, the directing comprising providing live parking guidance to facilitate maneuvering the arriving vehicle into position in the dynamically defined parking space, wherein the dynamically defined parking space is an initial parking space to which the arriving vehicle is initially directed;

observing the arriving vehicle in maneuvering into the initial parking space;

determining, based on the observing, that the initial parking space is sub-optimal;

based on determining that the initial parking space is sub-optimal, dynamically defining a different parking space in another unoccupied area within the parking area; and re-directing the arriving vehicle to the dynamically defined different parking space.

2. The method of claim 1, wherein the providing the live parking guidance comprises visually indicating the dynamically defined parking space in the parking area.

3. The method of claim 2, wherein the visually indicating the dynamically defined parking space comprises using lighting devices installed in the parking area to project light onto a surface of the parking area, the projected light delineating the dynamically defined parking space.

4. The method of claim 1, wherein the providing the live parking guidance comprises providing to the arriving vehicle audio-based directions to the dynamically defined parking space.

5. The method of claim 1, wherein the providing the live parking guidance comprises providing to the arriving vehicle a recommended parking orientation, wherein the recommended parking orientation is selected from the group consisting of a recommendation to pull forward into the dynamically defined parking space, and a recommendation to back into the dynamically defined parking space.

6. The method of claim 1, wherein the obtaining the skills assessment of the driver comprises dynamically assessing driver skill as the driver drives the arriving vehicle around at least a portion of the parking area and based on observing the arriving vehicle driving around the portion of the parking area.

7. The method of claim 1, wherein the obtaining the skills assessment of the driver comprises:

directing the arriving vehicle to a skill test area of the parking area; and observing the driver's skill in performing the at least one parking maneuver with the arriving vehicle in the skill test area.

8. The method of claim 1, wherein the choosing the dimensions for the dynamically defined parking space is based on the skill level of the driver and an approach in which lower driver skill level results in choosing larger dimensions for the dynamically defined parking space.

9. The method of claim 1, further comprising:

receiving from the arriving vehicle indications of vehicle characteristics including indications of vehicle dimensions of the arriving vehicle; and verifying accuracy of the indicated vehicle dimensions, wherein the verifying performs the automated measurement of the least one dimension.

10. The method of claim 9, wherein the vehicle characteristics include available guidance-providing features of the arriving vehicle, and wherein the dynamically defining the parking space considers assistance potentially available from the guidance-providing features in assisting the driver in maneuvering into parking spaces.

11. The method of claim 1, further comprising:

obtaining an indication of a type of tire installed on the arriving vehicle;

ascertaining a vehicle turning radius based at least in part on the indicated type of tire; and assessing, based at least in part on the ascertained vehicle turning radius, accessibility of one or more locations in the parking area to the arriving vehicle, wherein the dynamically defining the parking space selects a location to allocate the dynamically defined parking space from the one or more locations in the parking area based on the assessing.

12. The method 1, wherein the dynamically defining the parking space comprises optimizing a position of the arriving vehicle in the parking area for ease of vehicle ingress to, and ease of vehicle egress from, the parking area by a plurality of vehicles.

13. The method of claim 12, further comprising obtaining an indication of intended length of stay of the arriving vehicle in the parking area, wherein the optimizing the position of the arriving vehicle accounts for the intended length of stay.

14. The method of claim 1, further comprising:

obtaining sensor data and video from vehicles driving through the parking area;

analyzing the sensor data and video to ascertain location of one or more obstructions and unoccupied space in the parking area; and using the ascertained location of the one or more obstructions in the dynamically defining the parking space to identify a location for the dynamically defined parking space.

15. A computer system comprising:

a memory; and a processor in communication with the memory, wherein the computer system is configured to perform a method comprising:

performing an automated measurement of at least one dimension of an arriving vehicle arriving at a parking area, the arriving vehicle to be parked in the parking area;

obtaining a skills assessment of a driver of the arriving vehicle, the skills assessment indicating skill level of the driver in performing at least one parking maneuver;

dynamically defining a parking space in an unoccupied area within the parking area for the arriving vehicle based at least on the at least one dimension of the arriving vehicle and the obtained skills assessment, the defining comprising allocating the dynamically defined parking space in the unoccupied area, the allocating comprising choosing dimensions for the dynamically defined parking space;

directing the arriving vehicle to the dynamically defined parking space, the directing comprising providing live parking guidance to facilitate maneuvering the arriving vehicle into position in the dynamically defined parking space, wherein the dynamically defined parking space is an initial parking space to which the arriving vehicle is initially directed;

observing the arriving vehicle in maneuvering into the initial parking space;

determining, based on the observing, that the initial parking space is sub-optimal;

based on determining that the initial parking space is sub-optimal, dynamically defining a different parking space in another unoccupied area within the parking area; and re-directing the arriving vehicle to the dynamically defined different parking space.

16. The computer system of claim 15, wherein the providing the live parking guidance comprises visually indicating the dynamically defined parking space in the parking area, wherein the visually indicating the dynamically defined parking space comprises using lighting devices installed in the parking area to project light onto a surface of the parking area, the projected light delineating the dynamically defined parking space.

17. The computer system of claim 15, wherein the obtaining the skills assessment of the driver comprises dynamically assessing driver skill as the driver drives the arriving vehicle around at least a portion of the parking area and based on observing the arriving vehicle driving around the portion of the parking area.

18. A computer program product comprising:

a computer readable storage medium readable by a processing circuit and storing instructions for execution by the processing circuit for performing a method comprising:

performing an automated measurement of at least one dimension of an arriving vehicle arriving at a parking area, the arriving vehicle to be parked in the parking area;

obtaining a skills assessment of a driver of the arriving vehicle, the skills assessment indicating skill level of the driver in performing at least one parking maneuver;

dynamically defining a parking space in an unoccupied area within the parking area for the arriving vehicle based at least on the at least one dimension of the arriving vehicle and the obtained skills assessment, the defining comprising allocating the dynamically defined parking space in the unoccupied area, the allocating comprising choosing dimensions for the dynamically defined parking space;

directing the arriving vehicle to the dynamically defined parking space, the directing comprising providing live parking guidance to facilitate maneuvering the arriving vehicle into position in the dynamically defined parking space, wherein the dynamically defined parking space is an initial parking space to which the arriving vehicle is initially directed;

observing the arriving vehicle in maneuvering into the initial parking space;

determining, based on the observing, that the initial parking space is sub-optimal;

based on determining that the initial parking space is sub-optimal, dynamically defining a different parking space in another unoccupied area within the parking area; and re-directing the arriving vehicle to the dynamically defined different parking space.

19. The computer program product of claim 18, wherein the providing the live parking guidance comprises visually indicating the dynamically defined parking space in the parking area, wherein the visually indicating the dynamically defined parking space comprises using lighting devices installed in the parking area to project light onto a surface of the parking area, the projected light delineating the dynamically defined parking space.

* * * * *